United States Patent [19]

Aoki

[11] Patent Number: 4,931,609

[45] Date of Patent: Jun. 5, 1990

[54] HIGH-FREQUENCY HEATING APPARATUS HAVING A DIGITAL-CONTROLLED INVERTER

[75] Inventor: Masayuki Aoki, Ichinomiya, Japan

[73] Assignee: Kabushiki Kaisha Toshiba, Kawasaki, Japan

[21] Appl. No.: 357,722

[22] Filed: May 26, 1989

[30] Foreign Application Priority Data

May 30, 1988 [JP] Japan ..... 63-132322

[51] Int. Cl.[5] ..... H05B 6/68

[52] U.S. Cl. ..... 219/10.55 B; 219/492; 219/10.77; 363/97; 363/131; 323/283

[58] Field of Search ..... 219/10.55 B, 10.77, 219/490, 492; 363/96, 97, 98, 131, 132; 323/283

[56] References Cited

U.S. PATENT DOCUMENTS

| | | | |
|---|---|---|---|
| 4,002,875 | 1/1977 | Kiuchi et al. | 219/10.55 B |
| 4,308,443 | 12/1981 | Tucker et al. | 219/10.77 |
| 4,453,068 | 6/1984 | Tucker et al. | 219/10.77 |
| 4,507,531 | 3/1985 | Teich et al. | 219/10.55 B |
| 4,686,340 | 8/1987 | Fukasawa | 219/10.77 |
| 4,701,588 | 10/1987 | Fukasawa | 219/10.77 |
| 4,724,291 | 2/1988 | Inumada | 219/10.55 B |
| 4,777,575 | 10/1988 | Yamato et al. | 363/97 |
| 4,825,028 | 4/1989 | Smith | 219/10.55 B |

FOREIGN PATENT DOCUMENTS 57-10076 2/1982 Japan .

*Primary Examiner*—Philip H. Leung

*Attorney, Agent, or Firm*—Cushman, Darby & Cushman

[57] ABSTRACT

A high-frequency heating source supplies a predetermined high-frequency heating power. An AC input is supplied to an inverter circuit. The inverter circuit generates a high-frequency output signal for driving the high-frequency heating source. The inverter circuit comprises a rectifier circuit for rectifying the AC input, and a switching element for switching the DC output supplied from the rectifier circuit. The inverter circuit is controlled by an inverter control circuit. A processor supplies set heating-output data associated with the high-frequency heating power to the inverter control circuit. The inverter control circuit comprises a counter and an on/off signal generator. The counter is set to a on-period in accordance with the set heating-output data, and performs counting operation. The on/off signal generator generates an on/off signal in accordance with a count value of the counter. A driving circuit drives the switching element of the inverter circuit in response to the on/off signal supplied from the inverter control circuit.

22 Claims, 3 Drawing Sheets

HIGH-FREQUENCY HEATING APPARATUS HAVING A DIGITAL-CONTROLLED INVERTER

BACKGROUND OF THE INVENTION

1. Field of the Invention

This invention relates to a high-frequency heating apparatus having an inverter circuit, and more particularly to a high-frequency heating apparatus whose output heat can be set over a broad range and which is suitable for use as a cooking apparatus such as a microwave oven.

2. Description of the Related Art

As is known in the art, a type of cooking apparatuses such as microwave ovens, which has a high-frequency heating device, has an inverter circuit for supplying drive power to the heating device. Such a cooking apparatus is disclosed in U.S. Pat. No. 4,724,291. This cooking apparatus also has, besides an inverter circuit, an oscillator circuit for generating a sawtooth-wave signal, a pulse-width modulating circuit for performing pulse-width modulation on the sawtooth-wave signal in accordance with a signal setting the output of the heating device, and a drive circuit for turning on and off the switching element of the inverter circuit in accordance with the output of the pulse-width modulating circuit. Therefore, the output of the heating device can be continuously controlled over a broad range. Due to the use of the inverter circuit, it is sufficient for the cooking apparatus to have a small, light high-voltage transformer. Hence, the cooking apparatus can be compact as a whole.

However, the cooking apparatus of the type described above has a drawback. Since the oscillator circuit and the pulse-width modulating circuit process analog data to control the inverter circuit, the output of the heating device will be different from the desired value if the constants of the oscillator circuit and the pulse-width modulating circuit differ from the design values. When the heating device outputs more or less heat than desired, the cooking apparatus cannot cook food properly.

When the constants of the oscillator circuit and the pulse-width modulating circuit differ very much from the design values, a voltage higher than the rated one, or a current greater than the rated one is applied to the switching element of the inverter circuit, inevitably breaking down the switching element. To prevent the breakdown of the switching element, a circuit can be used which changes the constants of the oscillator circuit and the pulse-width modulating circuits to the design values. The use of this additional component renders the cooking apparatus complex in structure, and raises the manufacturing cost of the apparatus.

The above problem is also inherent in a so-called "electromagnetic induction cooking apparatus" which has an analog-controlled inverter and which performs high-frequency induction heating.

SUMMARY OF THE INVENTION

It is, therefore, an object of the present invention to provide a new and improved high-frequency heating apparatus having a digital-controlled inverter circuit, which has a relatively simple structure and can thus be manufactured at low cost, can generate heat in a desired amount, can prevent the breakdown of the switching element of the inverter circuit.

Another object of the invention is to provide a high-frequency heating apparatus having an inverter circuit and improved in safety, which is relatively simple structure and can thus be manufactured at low cost, and can not only generate heat in a desired amount to cook food appropriately, and but also prevent the breakdown of the switching element of the inverter circuit even if a noise-containing signal is input to the inverter circuit.

Still another object of the present invention is to provide a modified, high-frequency heating apparatus having an inverter circuit, which has a relatively simple structure and can thus be manufactured at low cost, and can not only generate heat in a more desired amount to cook food appropriately, and but also prevent the breakdown of the switching element of the inverter circuit more reliably.

According to one aspect of the present invention, there is provided a high-frequency heating apparatus comprising:

a high-frequency heating source for providing a predetermined high-frequency heating power;

inverter means for receiving an AC input, and providing a high-frequency output for driving said high-frequency heating source, said inverter means including rectifying means for rectifying the AC input and a switching element for switching a DC output supplied from the rectifying means;

processor means for providing set heating-output data associated with said high-frequency heating power;

inverter-controlling means including counter means for setting an on-period in accordance with the set heating-output data supplied from said processor means and performing counting operation, and means for generating an on/off signal in accordance with a count value of the counter means; and drive means for driving said switching element of said inverter means in response to the on/off signal supplied from said inverter-controlling means.

According to another aspect of the invention, there is provided a high-frequency heating apparatus having an inverter circuit with a switching, said cooking apparatus comprising:

an oscillator circuit generating pulses at a predetermined frequency;

a counter initially set to a count value corresponding to a desired heat-output, for counting down the initial count value in accordance with the pulses generated by said oscillator circuit, thereby to set an on-period of the switching element of said inverter circuit;

means for generating an on-signal and an off-signal in accordance with the count value of said counter, and supplying these signals to the switching element of said inverter circuit; and means for supplying a start signal to the counter in accordance with the condition of said inverter circuit.

The high-frequency heating apparatus according to the present invention has a relatively simple structure and can thus be manufactured at low cost, can generate heat in a desired amount. Further, the apparatus can prevent the breakdown of the switching element of the inverter means.

The high-frequency heating apparatus according to the invention is relatively simple structure and can thus be manufactured at low cost, and can yet generate heat in a desired amount to cook food appropriately. Since the counter performs analog control on the inverter circuit, no excessive currents or no excessive voltages are applied to the switching element of the inverter circuit, thus preventing the breakdown of the switching elements.

The high-frequency heating apparatus can further comprise means for inhibiting the supply of the start signal to the counter as long as the switching elements of the inverter circuit remain on. In this case, the counter is prevented from operating even if a noise-containing signal is input to it, whereby no excessive currents or no excessive voltages are applied to the switching elements of the inverter circuit.

The oscillation circuit of the heating apparatus can be the type having a ceramic oscillator or a quartz oscillator whose oscillation frequency is such that the counter cannot continuously operate longer than a predetermined period of time. Since the oscillation circuit has either a ceramic oscillator or a quartz oscillator, it operates stably, allowing the counter to operate also stably. The stable operation of the counter results in generation of heat in a desired amount. In addition, since the operation time of the counter is limited, no excessive currents or no excessive voltages are applied to the switching elements of he inverter circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

Figure 1:
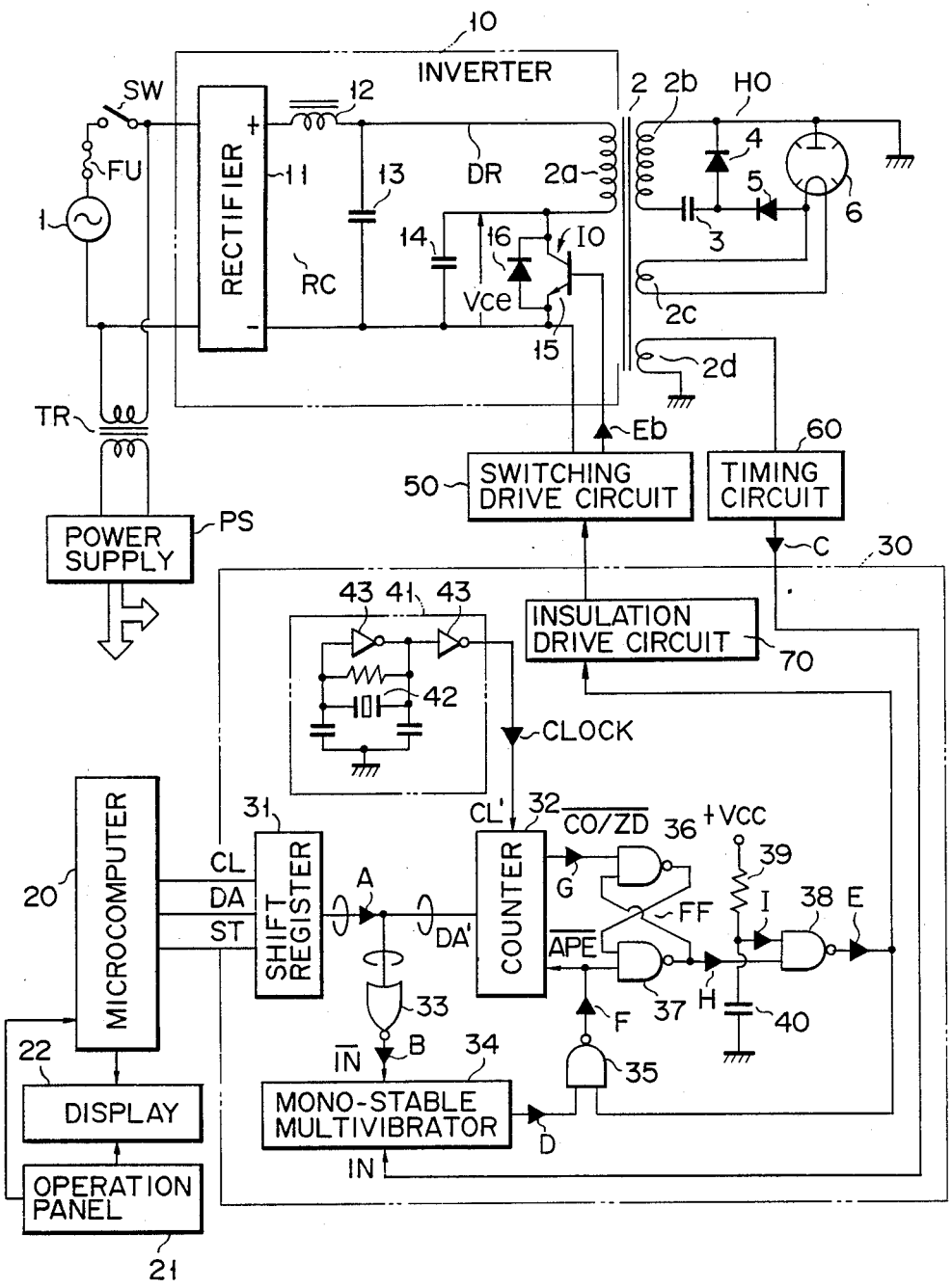
FIG. 1 is a diagram showing an electric circuit which is an embodiment of the present invention.

Reference will now be made in detail to the presently preferred embodiments of the invention as illustrated in the accompanying drawings, in which like reference characters designate like or corresponding parts throughout the several drawings.

Figure 2:
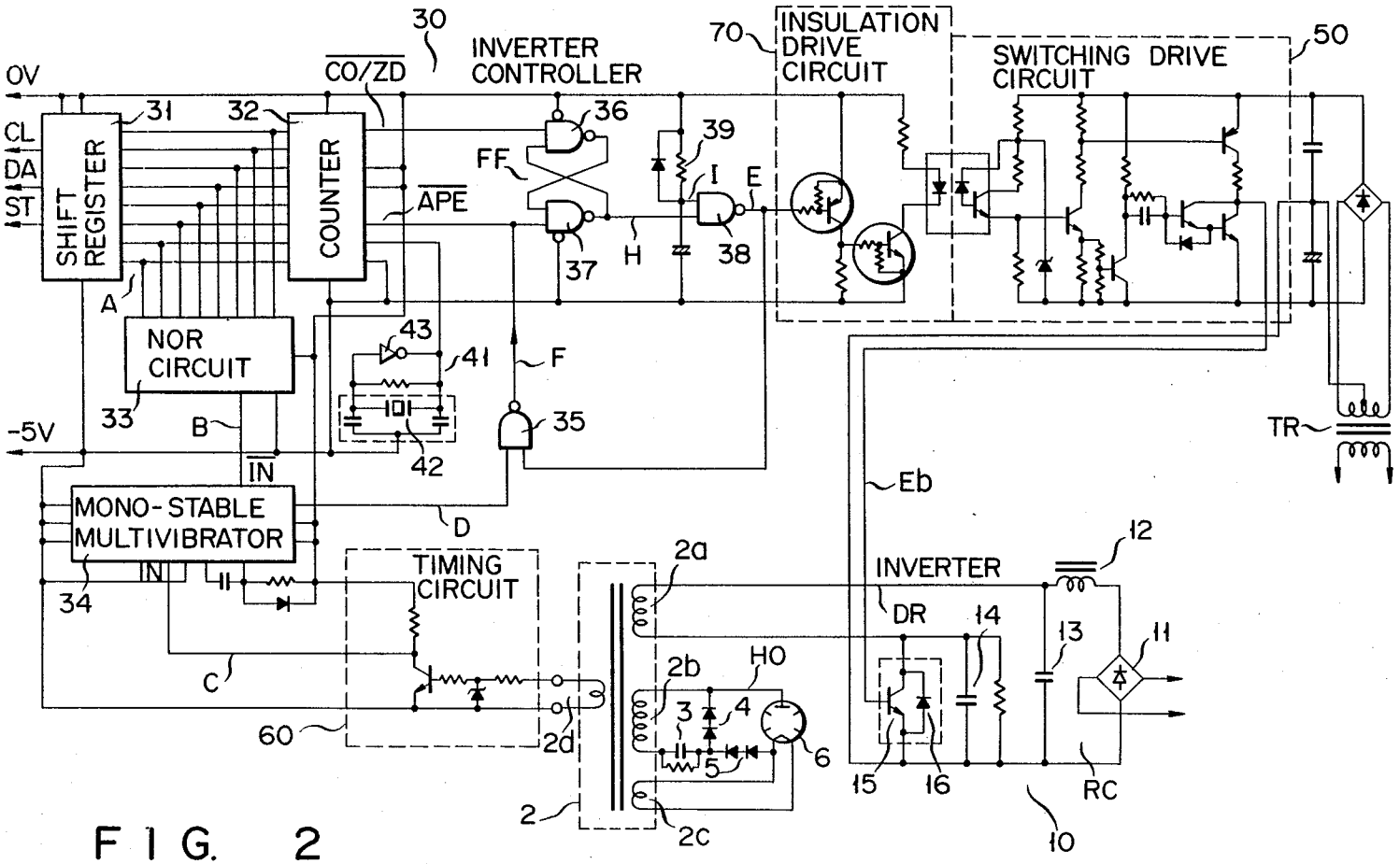
FIG. 2 is a detailed diagram showing an essential portion of FIG. 1.

As is shown in FIGS. 1 and 2, a microwave oven apparatus according to the invention has an inverter circuit 10. The inverter circuit 10 is connected to a commercially available AC power supply 1 by a fuse FU and a main switch SW. Also, an auxiliary power supply PS is connected to the power supply 1 by an auxiliary transformer TR. The supply PS is a circuit for applying a prescribed DC voltage to other components of the high-frequency heating apparatus, such as a microcomputer 20, an inverter controller 30, a switching drive circuit 50, a timing circuit 60 and an insulation drive circuit 70 (each later described).

The inverter circuit 10 comprises a rectifier circuit RC and a resonant circuit DR connected to the output of the rectifier circuit RC, an NPN transistor 15 functioning as a switching element, and a damper diode 16. The rectifier circuit RC includes a rectifier 11, a choke coil 12, and a smoothing capacitor 13. The resonant circuit DR comprises the primary winding 2*a* of a high-voltage transformer 2 and a capacitor 14. The transistor 15 and the damper diode 16 are packaged as a unit. The collector-emitter path of the transistor 15 is connected in parallel to the capacitor 14. Also, the damper diode 16 is connected in parallel to the capacitor 14. When the transistor 15 is repeatedly turned on and off, the resonant circuit DR is excited, whereby a high-frequency current flows through the primary winding 2*a* of the transformer 2.

The microwave oven further comprises a heating section HO is connected to the secondary winding 2*b* of the high-voltage transformer 2. The heating section HO has a half-wave, voltage-doubler rectifier and a magnetron 6 used as a high-frequency heat source. The voltage-doubler rectifier circuit includes a high-voltage capacitor 3 and high-voltage diodes 4 and 5, and connects the anode and cathode of the magnetron. The anode of the magnetron 6 is connected to the ground. The cathode of the magnetron 6, which functions as a heater, is coupled to the secondary winding 2*b* of the high-voltage transformer 2.

The microwave oven further has a microcomputer 20, an operation panel 21, a display 22, and an inverter-controlling circuit 30. The microcomputer 20 is used to control the whole functions of the oven. It supplies the inverter-controlling circuit 30 with the data input by operating the operation panel 21 and representing a desired heat output. The display 22 is connected to both the microcomputer 20 and the operation panel 21, for displaying the data representing various conditions for cooking food.

The inverter-controlling circuit 30 has a shift register 31, a counter 32, a NOR circuit 33, a two-input monostable multivibrator 34, and a NAND circuit 35. The shift register 31 stores the heat-output data supplied from the microcomputer 20 to a data-input terminal DA. The counter 32 receives the output A of the shift register 31 at the input terminal DA'. The monostable multivibrator 34 receives, at its inverting input $\overline{\text{IN}}$, the output B of the NOR circuit 33, and at its noninverting input IN, the output C of the timing circuit 60 which will be described later. The NAND circuit 35 receives the output D of multivibrator 34 at one input terminal, and the output E of a NAND circuit 38 (later described) at the other input terminal.

The inverter-controlling circuit 30 further has a flip-flop circuit FF, a NAND circuit 38 connected to receive, at one input, the output H of the flip-flop circuit FF, an oscillator circuit 41, and a series circuit connected between a voltage terminal (+Vcc) and the ground. The flip-flop circuit FF is formed of a NAND circuit 36 for receiving the output G from the output terminal CARRY OUT/ZERO DETECT ($\overline{\text{COD}}$/ ) of the counter 32, and a NAND circuit 37 for receiving the output F of the NAND circuit 35. The series circuit is comprised of a resistor 39 and a capacitor 40.

The output F of the NAND circuit 35 is supplied to the input terminal ASYNCHRONOUS PRESET ENABLE ($\overline{\text{APE}}$) of the counter 32. The output of the oscillator circuit 41 is supplied to the clock input terminal of the counter 32. A voltage I is generated across the capacitor 40 from the DC voltage (Vcc) applied to the series circuit formed of the resistor 39 and the capacitor 40. The voltage I is applied to the other input terminal of the NAND circuit 38.

The shift register 31 converts the data output from the microcomputer 20, which is serial data, into parallel data. The register 31 has a clock terminal CL and a strobe terminal ST. These terminals CL and ST are connected to the clock terminal CL and strobe terminal ST of the microcomputer 30, thereby to expand the output port thereof. The shift register 31 may be used, for example, a 8-stage shift-and-store busregister TC4094 (Toshiba).

The numerical value of the data which the shift register continuously changes is supplied to the counter 32. The counter 32 counts this numerical value in synchronism with the output of the oscillator circuit 41, thereby to determine the on-period of the transistor 15 of the inverter circuit 10. The counter 32 may be used, for example, a 8-bit binary programmable down counter TC74HC4013P (Toshiba).

The oscillator circuit 41 comprises a high-precision oscillator 42 such as a ceramic oscillator and two NOT circuits 43. The oscillator 42 generates a clock signal of a predetermined frequency. The high precision oscillator 42 can also be a quartz oscillator. The frequency of the oscillator 42 of such a value that the counter 32 cannot continuously operate longer than a predetermined period of time as described latter in detail.

The microwave oven further comprises the switching drive circuit 50, the timing circuit 60 and the insulation drive circuit 70. The switching drive circuit 50 is connected to the output of the inverter-controlling circuit 30 via the insulation drive circuit 70, more precisely to the output terminal of the NAND circuit 38. This circuit 50 is designed to turn on or off the transistor 15 in accordance with the output E of the inverter-controlling circuit 30. It can be a so-called "based drive circuit" of the known type. The timing circuit 60 is coupled to the secondary winding 2*b* of the high-voltage transformer 2. This circuit 60 is used to detect, from the output of the secondary winding of the transformer 2, the time at which the inverter circuit 10 assumes a specific condition such as a substantially zero-crossing timing. It can be a zero detector the known type. The output C of the timing circuit 60 is supplied to the non-inverting input terminal IN of the multivibrator 34.

The secondary winding 2*b* of the transformer 2, the timing circuit 60, the multivibrator 34, and the NAND circuit 35 constitute means for supplying a start signal to the counter 32, in accordance with the condition of the inverter circuit 10. On the other hand, the NAND circuit 35, the flip-flop circuit FF, the resistor 36, the capacitor 40, and the NAND circuit 38 constitute means for inhibiting the supply of the start signal to the counter 32.

With reference to the timing chart of FIG. 3, it will now be explained how the microwave oven operates.

When the switch SW is turned on, the auxiliary power supply PS supplies power to the oscillator circuit 41 of the inverter-controlling circuit 30. As a result, the oscillator 42 starts vibrating at the frequency specific to it. Hence, the oscillator circuit 41 outputs a clock signal, as shown in CLOCK of FIG. 3. Also, when the switch SW is turned on, the capacitor 40 of the inverter-controlling circuit 30 starts accumulating electric charge, whereby the current I gradually increases as is understood from I of FIG. 3. The output E of the NAND circuit 38 remains at logic "1" level until the current I reaches the threshold level of the NAND circuit 38 at time t2, said threshold level indicated by the one-dot, one-dash line of I of FIG. 3. The switching circuit 50 holds the transistor 15 turned off as long as the signal E remains at logic "1" level as shown in E of FIG. 3.

Immediately after the switch SW has been turned on, the output of the microcomputer 20 is at neither the logic "1" level nor the logic "0" level. Hence, both the output A of the shift register 31 and the output B of the NOR circuit are not at either logic level, as shown in A and B of FIG. 3. Nonetheless, the output D of the multivibrator 34 quickly falls to the logic "0" level, as shown in D of FIG. 3. The output F of the NAND circuit 35 therefore rises to the logic "1" level, and is used as the start signal for the counter 32, as shown in F of FIG. 3.

When the input to the terminal $\overline{APE}$ of the counter 32, i.e., the output F of the NAND circuit 35 is at the logic "1" level, the counter 32 has a maximum count of 255 clock pulses, and outputs one clock pulse G at the logic "0" level to the terminal $\overline{COD}$/ of the counter 32, at time t1 for the first time after the switch SW has been turned on. Until the time t1, the output H of the NAND circuit 37 remains uncertain, then output G of the counter 32 rises to the logic "1" level upon lapse of one-clock period from time t1, as shown in G and H of FIG. 3. At this time, the output H of the NAND circuit 37 assumes the logic "0" level and remains at this level.

As long as time t1 precedes time t2, the output E of the NAND circuit 38 never falls to the logic "0" level immediately after time t2. The output data of the microcomputer 20 remains uncertain before the microcomputer 20 is initialized. The output A of the shift register 31 is also at neither the logic "1" level nor the logic "0" level. Hence, the output B of the NOR circuit 33 is at neither the logic "1" level nor the logic "0" level. If the output B assumes either the logic "1" level or the logic "0" level before time t2, the transistor 15 is never turned on. Namely, the NAND circuit 38 functions as a protection means for preventing the transistor 15 from being turned on and damaged while the microcomputer 20 is being initialized.

At time t3, the heat-output data is supplied from the microcomputer 20 to the shift register 31. Then, the shift register 31 outputs an 8-bit output A. The output A is set in the counter 32 as the initial count value thereof, and is supplied to the NOR circuit 33. The output B of the NOR circuit 33 falls from the logic "1" level to the logic "0" level. When the output B falls to the logic "0" level, the output D of the multivibrator 34 rises to the logic "1" level and remains at this level for a predetermined time. The output D at the logic "1" level is supplied to one input terminal of the NAND circuit 35. At this time, the other input (E) of the NAND circuit 35 is at the logic "1" level. Thus, the output F of the NAND circuit 35 falls to the logic "0" level.

When the output F of the NAND circuit 35 falls to the logic "0" level, the output G of the counter 32 is at the logic "1" level. Therefore, the output H of the NAND circuit 37 assumes the logic "1" level. Since the voltage I has a value equivalent to logic "1" after time t2, the output E of the NAND circuit 38 falls to the logic "0" level. The output F of the NAND circuit 35 rises to the logic "1" level. As a result of this, the output E of the NAND circuit 38 rises fast to the logic "1" level at time t4. That is, the output E remains at the logic "0" level for a extremely short period of time.

The counter 32 starts performing down-counting of the value set in it, when the output F of the NAND circuit 35 assumes the logic "0" level. When its count value decreases to zero at time t5, the counter 32 output a clock pulse at the logic "0" level. In other words, the output G of the counter 32 momentarily remains at the logic "0" level. Therefore, the output H of the NAND circuit 37 falls to the logic "0" level, and the output E of the NAND circuit 38 rises to the logic "1" level.

The output E of the NAND circuit 38 remains at the logic "0" level from time t4 to time t5. Thus, during the period between time t4 and t5, the output Eb of the switching circuit 50 is at the logic "1" level, and the transistor 15 remains on, as shown in Eb of FIG. 3. The collector current Ic flowing in the transistor 15 during this period forms a substantially triangular wave as is illustrated in Ic of FIG. 3.

When the transistor 15 is turned off at time t5, a current flows from the primary winding 2a of the high-voltage transformer 2 into the capacitor 14, whereby the collector-emitter voltage Vce of the transistor 15 increases. When the current flowing in the primary winding 2a decreases to zero, the capacitor 14 starts discharging the current, whereby the voltage Vce decreases. The timing circuit 60 detects time t6 at which the voltage Vce decreases to zero or thereabout, and its output C rises to the logic "1" level, as shown in C and Vce of FIG. 3. As a result of this, the output D of the multivibrator 34 rises to the logic "1" level and remains there for a predetermined period of time.

The sequence of the operations, which are performed during the period from t3 to t6, is repeated, thereby driving the magnetron 6. The magnetron 6 carries out high-frequency induction heating, applying the heat to food (not shown) and cooking it.

As has been described, the inverter controller 30, whose main component is the counter 32, performs digital control on the inverter circuit 10. Due to the digital control, the inverter circuit 10 is controlled to supply the heating section HO with a heat-output signal of the desired value, even if the circuit components have constants different from the design values. Since the microwave oven requires no means for compensating the difference of the circuit constants, it an be more simple and compact than the conventional microwave oven which needs to have such means since its inverter circuit is analog-controlled. Obviously, the microwave oven of the invention can cook food better than the conventional one. Further, due to the digital control of the inverter circuit 10, no excessive currents or no excessive voltages are applied to the transistor 15 (i.e., the switching element) of the inverter circuit 10). In addition, the inverter controller 30 require no interface devices to communicate with the microcomputer 20 since it is digital-controlled. This is another reason why the microwave oven is simple and compact.

Figure 3:
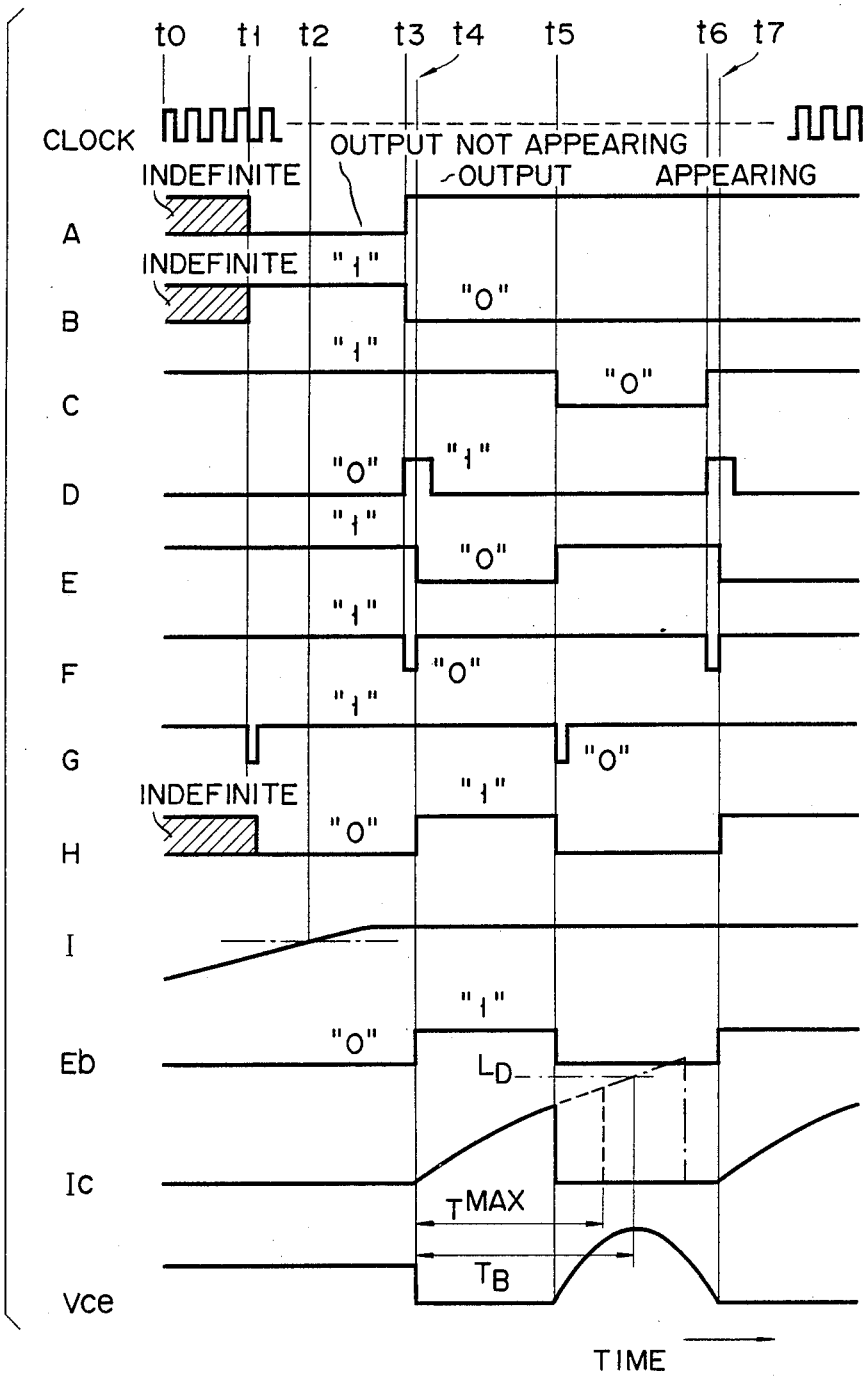
FIG. 3 is a timing chart explaining the operation of the embodiment illustrated in FIG. 1.

As is evident from FIG. 3, the output E of the NAND circuit 38 remains at the logic "0" level as long as the transistor 15 is on from time t4 to time t5. Hence, the output F of the NAND circuit 35 is maintained at the logic "1" level even if the signal B input to the multivibrator 34 contains noise and the output D thereof rises to the logic "1" level. Therefore, the counter 32 does not repeat unnecessary operations while the transistor 15 is on. In other words, the on-period of the transistor 15 does not last too long. No excessive currents or no excessive voltages are, therefore, applied to the transistor 15. This feature, along with the supply of the heat-output data of the desired value, helps greatly to prevent damages to the transistor 15.

Since the oscillator circuit 41 has the high-precision oscillator 42, it operates reliably, thus stabilizing the operation of the counter 32. As a result, the inverter circuit 10 generates data representing the heat output of the desired value.

As has been explained, the oscillator 42, which can be ceramic oscillator or a quartz oscillator, vibrates at such a frequency f that the counter 32 does not continuously operate longer than a predetermined period of time. When the counting time is T and the counting value is V, can be obtained $T=V/f$. Then, in Ic of FIG. 3, when $L_D$ is a damaged level of the transistor 15, a maximum counting time Tmax of the counter 32 and a damaging time $T_B$ of the transistor 15 may be determined, is satisfying $Tmax<T_B$, by selecting the frequency f of the oscillator 42. Thus, the transistor 15 never remains no longer than this period of time, whereby neither an excessive current nor an excessive voltage is applied to the transistor 15. This serves to improve the safety of the microwave oven.

The components of the inverter controller 30 can be packaged as an integrated gate-array. In this case, the microwave oven is more simple and can be assembled more easily.

The present invention is not limited to the microwave oven described above. It can apply to an electromagnetic cooking apparatus which has an inverter circuit. Moreover, various changes and modification can be made in a high-frequency heating apparatus having an inverter, without departing the scope of the present invention.

As can be understood from the above, the present invention can provide a high-frequency heating apparatus comprising an inverter circuit having a switching element; an oscillator circuit generating pulses at a predetermined frequency; a counter initially set to a count value corresponding to a desired heat-output, for count down the initial count value in accordance with the pulses generated by the oscillator circuit, thereby to set an on-period of the switching element of the inverter circuit; means for generating an on-signal and an off-signal in accordance with the count value of the counter, and supplying these signals to the switching element of the inverter circuit; and means for supplying a start signal to the counter in accordance with the condition of the inverter circuit. The apparatus is, therefore, relatively simple structure and can thus be manufactured at low cost, and can yet generate heat in a desired amount to cook food appropriately. Further, the breakdown of the switching element of the inverter circuit can be prevented.

The apparatus can further comprise means for inhibiting the supply of the start signal to the counter as long as the switching element of the inverter circuit remain on. In this case, the counter is prevented from operating even if a noise-containing signal is input to it, whereby no excessive currents or no excessive voltages are applied to the switching element of the inverter circuit.

The oscillation circuit can be the type having a ceramic oscillator or a quartz oscillator whose oscillation frequency is such that the counter cannot continuously operate longer than a predetermined period of time. Since the oscillation circuit has either a ceramic oscillator or a quartz oscillator, it operates stably, allowing the counter to operate also stably. The stable operation of the counter results in the generation of a desired amount of heat. In addition, since the operation time of the counter is limited, no excessive currents or no excessive voltages are applied to the switching element of the inverter circuit.

What is claimed is:

1. A high frequency heating apparatus comprising:

high frequency radiation generating means for generating high frequency radiation when a high voltage is applied to input terminals thereof; an inverter comprising:

a DC power source for supplying a DC voltage between first and second terminals thereof;

a step-up transformer comprising:

a primary having a first tap connected to the first terminal of the Dc power source and having a second tap; and a secondary having output terminals connected to the input terminals of the high frequency radiation generating means and having a secondary voltage monitoring output indicative of the voltage on the output terminals;

switching means, having a first current conduction terminal connected to the second tap of the primary of the step-up transformer means, a second current conduction terminal connected to the second terminal of the DC power source, and a current control input, the switching means having a predetermined capacitance between the first current conduction terminal and the second conduction terminal, for causing the current conduction terminals to short or to open depending upon the signal on the current control input; and inverter-controlling means, having a secondary voltage monitoring input connected to the secondary voltage monitoring output of the step-up transformer, a switching means control output connected to the current control input of the switching means, and a digital ON-time input, for:

causing the switching means to short for an ON period of time, the ON period of time being determined by the digital value of a signal applied to the digital ON-time input, a zero voltage appearing on the secondary voltage monitoring input indicating that a zero voltage exists across the secondary during the ON period of time;

causing the switching means to remain open after the ON period of time until the voltage on the secondary voltage monitoring input again indicates that the voltage on the secondary has reached the zero voltage.

2. The apparatus of claim 1 wherein when the switching means is opened after the ON period the voltage between the first and second taps of the primary undergoes a half period sinusoidal oscillation.

3. The apparatus of claim 1 wherein the high frequency generating means comprises a magnetron.

4. The apparatus of claim 1 wherein the DC power source has AC input terminals, the DC power source comprising:

a rectifying means, having AC input terminals connected to the AC input terminals of the DC power source, for generating a rectified output signal at rectified output terminals thereof; and a smoothing capacitor connected across the output terminals of the rectifying means, the smoothing capacitor also being connected between the first output of the DC power source and the second output of the DC power source.

5. The apparatus of claim 1 wherein the switching means comprises a transistor and a capacitor connected in parallel with one another.

6. The apparatus of claim 1 wherein the inverter-controlling means limits the ON period of time that the switching means is shorted so that the maximum voltage between the first and second current conduction terminals of the switch means is maintained below a predetermined protection voltage.

7. The apparatus of claim 1 wherein the amount of power supplied to the high frequency radiation generating means is varied by varying the ON period of time that the switching means is shorted.

8. The apparatus of claim 1 wherein: the inverter-controlling means comprises:

a clock signal generating means for generating a clock signal with a constant cycle time; and a state-machine means, having a clock signal input for receiving the clock signal from the clock signal generating means, a period count input connected to the digital ON-time input, a start input connected to the secondary voltage monitoring input, and a pulse output connected to the switching means control output, for generating an output pulse on the pulse output of a duration equal to a number of cycle times of the clock signal, the number of cycle times being determined by the period count input.

9. The apparatus of claim 8 wherein the clock signal generating means comprises a crystal controlled oscillator.

10. The apparatus of claim 8 wherein the clock signal generating means comprises a ceramic oscillator.

11. The apparatus of claim 8 further comprising:

a power-on protection means for prohibiting the inverter controlling means from causing the switching means to short for a predetermined power-on period of time after power is first applied to the inverter controlling means.

12. The apparatus of claim 11 wherein the power on protection means comprises a resistor of resistance R and a capacitor of capacitance C and the predetermined power-on period of time is controlled by the RC time constant.

13. The apparatus of claim 12 wherein the resistor and the capacitor are connected in series between power and ground.

14. The apparatus of claim 1 further comprising:

a microcomputer means comprising a operation panel, a display, and a microcomputer, the microcomputer means being connected to the digital ON-time input of the inverter controlling means, for:

inputting a desired heat-output from the operation panel; and outputting digital ON-time control values onto the digital ON-time input in accordance with the desired heat-output so that a larger desired heat-output results in a longer ON period of time and so that a smaller desired heat output results in a smaller ON period of time.

15. A high-frequency heating apparatus comprising:

(a) a high-frequency heating source for providing a predetermined high-frequency heating power;

(b) inverter means for receiving an AC input, and providing a high frequency output for driving the high frequency heating source, the inverter means comprising:

a rectifying means for rectifying the AC input; and
a switching means for switching a DC output supplied from the rectifying means;

(c) microcomputer means for providing set heating-output data associated with the high-frequency heating power;

(d) inverter-controlling means comprising:

(1) counter means for generating an on-period in accordance with the set heating-output data supplied from the microcomputer means;

(2) clock generating means for generating a clock signal with a specific frequency and supplying the clock signal to the counter means for counting, the frequency being set so that the maximum on-period which could be generated by the counter means will not cause the switching means to be damaged;

(3) means for causing the counter means to start operating when the microcomputer means provides the set heating output data;

(4) timing means for detecting when the voltage across the switching means is zero, and for causing the counter means to start operating again when the voltage across the switching means is zero;

(5) protection means for processing the on-period output from the counter means into a drive equal so as to protect the switching means of the inverter means by not allowing an on-period of the counter means to cause the drive signal to operate the switching means until the processor means is initialized;

(6) inhibiting means for substantially inhibiting the counter means from counting, while the switching means of the inverter means is operating; and (7) means for generating an on/off signal in accordance with the drive signal of the protection means; and (e) drive means for driving the switching means of the inverter means in response to the on off signal supplied from the inverter-controlling means.

16. The high-frequency heating apparatus of claim 15 wherein the clock generating means is a ceramic oscillator.

17. The high-frequency heating apparatus of claim 15 wherein the clock generating means is a quartz oscillator.

18. The high-frequency heating apparatus of claim 15 wherein the timing means detects when the voltage across the switching means decreases to zero.

19. The high-frequency heating apparatus of claim 15 wherein the protection means includes a time-constant circuit.

20. The high-frequency heating apparatus of claim 15 wherein the high frequency heating source includes a magnetron.

21. The high-frequency heating apparatus of claim 20 wherein the magnetron is connected to the inverter means by a high-voltage transformer and a rectifier circuit.

22. The high-frequency heating apparatus of claim 21 wherein the high voltage transformer includes a secondary winding coupled to the timing means.

* * * * *